US007814887B2

(12) United States Patent
Cwielong et al.

(10) Patent No.: US 7,814,887 B2
(45) Date of Patent: Oct. 19, 2010

(54) METHOD AND DEVICE FOR CONTROLLING A PUMP CONNECTED TO A FUEL RAIL

(75) Inventors: Martin Cwielong, Regensburg (DE); Matthias Delp, Bad Abbach (DE); Gerhard Eser, Hemau (DE)

(73) Assignee: Continental Automotive GmbH, Hannover (DE)

( * ) Notice: Subject to any disclaimer, the term of this patent is extended or adjusted under 35 U.S.C. 154(b) by 66 days.

(21) Appl. No.: 12/196,250

(22) Filed: Aug. 21, 2008

(65) Prior Publication Data

US 2009/0050112 A1 Feb. 26, 2009

(30) Foreign Application Priority Data

Aug. 24, 2007 (DE) ..... 10 2007 040 122

(51) Int. Cl.
*F02M 69/46* (2006.01)
*F02M 69/50* (2006.01)

(52) U.S. Cl. ..... 123/456; 123/504

(58) Field of Classification Search ..... 123/504, 123/457, 456, 497, 496, 500, 501, 503, 505, 123/510
See application file for complete search history.

(56) References Cited

U.S. PATENT DOCUMENTS 5,373,827 A * 12/1994 Kondou et al. ..... 123/478
5,740,783 A * 4/1998 Learman et al. ..... 123/497
6,250,285 B1 * 6/2001 Takase ..... 123/456
6,701,898 B2 * 3/2004 Tokuo et al. ..... 123/456

FOREIGN PATENT DOCUMENTS

| | | |
|---|---|---|
| DE | 10149237 | 10/2001 |
| DE | 10314036 | 3/2003 |
| DE | 10329065 | 6/2003 |
| DE | 102005043684 | 9/2005 |

* cited by examiner

*Primary Examiner*—Mahmoud Gimie
(74) *Attorney, Agent, or Firm*—King & Spalding L.L.P.

(57) ABSTRACT

In a method and a device for controlling a pump (14, 20) connected to a fuel rail (12) in an internal combustion engine, in order to provide a predetermined quantity of fuel in the fuel rail (12) for a predetermined operating state, the following steps are provided: determining whether a process occurs that switches the internal combustion engine into a next predetermined operating state; determining a pump output of the pump (14, 20) if the process for switching the internal combustion engine into a predetermined operating state was detected, whereby the pump output of the pump (14, 20) is selected such that the predetermined quantity of fuel is provided for the operating state; and actuating the pump (14, 20) so that the pump (14, 20) provides the predetermined quantity of fuel when the predetermined operating state is reached.

18 Claims, 1 Drawing Sheet

METHOD AND DEVICE FOR CONTROLLING A PUMP CONNECTED TO A FUEL RAIL

CROSS-REFERENCE TO RELATED APPLICATIONS

This application claims priority to German application number 10 2007 040 122.3 filed Aug. 24, 2007, the contents of which are hereby incorporated by reference in its entirety.

TECHNICAL FIELD

The invention relates to a method and a device for controlling a pump connected to a fuel rail in an internal combustion engine.

BACKGROUND

In general in an internal combustion engine, fuel is supplied from the tank to the supply line of a downstream high-pressure pump by means of a fuel pump. The high-pressure pump supplies the fuel into a reservoir or a fuel rail. This fuel supply unit may preferably be controllable in such a way that only the amount of fuel that is actually required is supplied and there is no unnecessary pump output. In internal combustion engines with high-pressure direct injection, a high-pressure fuel pump must supply fuel to the reservoir or the fuel rail. The fuel supply device, consisting of a low-pressure pump and the high-pressure pump, is designed to supply only the amount of fuel that is actually required according to the injection quantity and the fuel pressure level.

The fuel mass can be influenced by design-specific actuators that are subject to a time lag. In engines with stroke change-over, a very rapid change in the air mass in the cylinder is caused by the change-over of the valve stroke characteristic curve. Due to this altered air mass, the injection mass must also be altered accordingly, which in turn requires a very rapid adjustment of the actuation of the delivery rate of the fuel pump.

In the prior art, fuel was previously firstly injected in motor vehicles by means of an injector. For this, a suitable quantity of fuel for the next stroke is supplied by a pump when the system is to change to the next stroke for example. However, this does not take into consideration that, for example, the pump provides the quantity of fuel with a certain delay so that the quantity of fuel may in some circumstances be pumped into an associated fuel rail too early or too late. Furthermore, too much or too little fuel may as a result thus be injected by the injectors for example, resulting in a subsequent adjustment of the supposedly insufficient quantity of fuel, even though the correct quantity of fuel had been determined beforehand, but was provided too early or too late.

SUMMARY

A method and a device can be provided with which the control of the pump output of a pump that is connected to a fuel rail can be improved.

According to an embodiment, a method for controlling a pump that is connected to a fuel rail of an internal combustion engine in order to provide a predetermined quantity of fuel to the fuel rail for a predetermined operating state, may comprise the steps: a) Determining whether a process occurs to switch the internal combustion engine into a next predetermined operating state, b) Determining a pump output of the pump if the process for switching the internal combustion engine into a predetermined operating state was detected, wherein the pump output of the pump is selected so that the predetermined quantity of fuel for the operating state is provided, and c) Actuating the pump so that the pump provides the predetermined quantity of fuel when the predetermined operating state is achieved.

According to a further embodiment, the pump can be actuated for instance as a function of a time lag of the switch into the predetermined operating state and a time lag of the fuel system or a time lag of the pump. According to a further embodiment, the pump can be actuated in such a way that, taking into consideration a time lag of the pump, the pump has pumped the predetermined quantity of fuel into the rail at the end of a time lag in the switch into the predetermined operating state. According to a further embodiment, the detection of a signal can be used to determine whether a process for switching the internal combustion engine into a predetermined operating state is taking place for example, wherein the predetermined operating state is a stroke change-over to a next stroke and the process for switching the internal combustion engine into the next stroke is detected using a signal for stroke change-over for example. According to a further embodiment, the pump output of the pump can be determined as a function of the air mass change, the injection fuel mass change and/or the absolute injection fuel mass. According to a further embodiment, the pump can be a high-pressure pump or a low-pressure pump.

According to another embodiment, a device for controlling a pump that is connected to a fuel rail of an internal combustion engine in order to provide a predetermined quantity of fuel to the fuel rail for a predetermined operating state, may comprise: a detecting device for detecting a process according to which the internal combustion engine is switched into a predetermined operating state, a device for determining a pump output of the pump when the detecting device detects the process for switching the internal combustion engine into a predetermined operating state, wherein the pump output of the pump is selected such that the pump provides the predetermined quantity of fuel for the predetermined operating state, and a control device for actuating the pump in such a way that the pump provides the predetermined quantity of fuel when the predetermined operating state is achieved.

According to a further embodiment, the device for determining the pump output of the pump may take into consideration the air mass change, the injection fuel mass change and/or the absolute injection fuel mass in the predetermined operating state for the determination of the pump output for the predetermined quantity of fuel. According to a further embodiment, the control device may actuate the pump for example as a function of a time lag of a switching process into the predetermined operating state and a time lag of the fuel system or a time lag of the pump. According to a further embodiment, the control device can be configured in such a way that it actuates the pump so that the pump has pumped the predetermined quantity of fuel into the rail at the end of the time lag of the switching process into the predetermined operating state, taking consideration of the time lag of the pump. According to a further embodiment, the predetermined operating state may be for example a stroke change-over to a next stroke and the detecting device detects the process according to which the internal combustion engine is switched into the predetermined operating state using a signal, for example a signal for the stroke change-over.

BRIEF DESCRIPTION OF THE DRAWINGS

The invention will now be described in more detail with reference to various embodiments in the accompanying drawings, in which.

DETAILED DESCRIPTION

Figure 1:
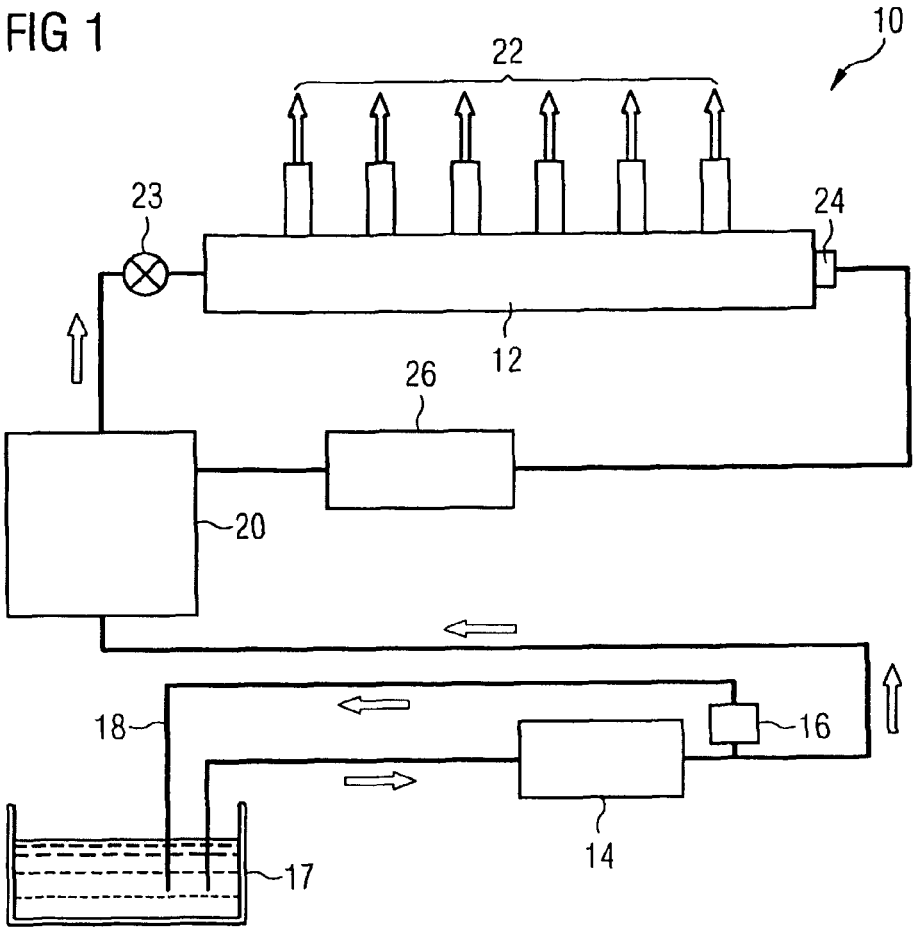
FIG. 1 shows a diagram in which a fuel system of an internal combustion engine is shown with a fuel supply device according to an embodiment.

According to various embodiments, actuating a pump that is connected to a fuel rail of an internal combustion engine can be provided in such a way that a predetermined quantity of fuel in the fuel rail can be provided for a predetermined operating state if this operating state occurs. For this, it is first determined whether a process occurs according to which the internal combustion engine is switched into a predetermined operating state. If the process for switching the internal combustion engine into the predetermined operating state is detected, a pump output of the pump is also determined, whereby the pump output is selected such that the predetermined quantity of fuel can be made available for the operating state. Furthermore, the pump is actuated in such a way that the pump provides the predetermined quantity of fuel when the predetermined operating state is reached.

This may have the advantage that the pump output of a pump is determined beforehand so that a predetermined quantity of fuel can be provided for a predetermined operating state and namely when this operating state is actually reached, for example when, for a stroke change-over, the valve changes to the next stroke, said stroke being a predetermined operating state. In contrast to this, in conventional systems the appropriate quantity of fuel cannot be provided reliably for the next stroke, for example at a stroke change-over. However, the "anticipatory" actuation of the pump according to various embodiments is however able to guarantee that the appropriate quantity of fuel can be made available at the correct time in the next stroke and that the formation of emissions can thus be reduced for example.

In a further embodiment, the process for switching the internal combustion engine into a predetermined operating state can be detected, for example using at least one signal for switching into the predetermined operating state. The predetermined operating state can be a stroke change-over into a next stroke for example and the process can be recorded using a signal for stroke change-over. The stroke change-over is a case where a particularly large air mass change can occur and where the provision of a suitable quantity of fuel is particularly important when the change-over process into the next stroke is completed, because the optimum combustion can be achieved in this way and no unnecessary pump output is required.

In another embodiment, time lags are taken into consideration for the actuation of the pumps in order to ensure that the pump only provides the desired predetermined quantity of fuel when the predetermined operating state, for example the change-over to the next stroke, is actually completed. To this end, the pump is actuated subject to a time lag of the predetermined operating state and a time lag of the fuel system or a time lag of the pump, for example.

In a further embodiment, the pump is actuated in such a way that, allowing for the time lag of the pump, the pump has pumped the predetermined quantity of fuel into the rail at the end of the time lag of the predetermined operating state, for example the stroke change-over. In this way, it is possible to ensure that the required quantity of fuel is not supplied in the rail too early or too late, but at the correct time when the switch to the predetermined operating state has been completed.

In a further embodiment, the pump output of the pump is determined as a function of the air mass change, the injection fuel mass change and/or the absolute injection fuel mass. This may have the advantage that these variables or parameters are normally known, for example for a stroke change from a small stroke to a large stroke and vice versa, and it is therefore easy to determine the required quantity of fuel and thus also the pump output of the pump.

According to a further embodiment, the pump can be a high-pressure pump or a low-pressure pump, as used in internal combustion engines or vehicles.

For the change-over of a valve stroke characteristic curve in an engine of a vehicle, the change-over does not usually occur immediately, but only after a certain time delay after actuators of a stroke change-over are actuated.

By means of the upstream signal for the change-over of the valve stroke characteristic curve or the signal for the stroke change-over and based on the knowledge of the time lags, the pump actuation can, in accordance with an embodiment, react more quickly to a subsequent air mass change and thus finally also to a fuel mass change by means of an appropriate control device, such as an ECU 26. This process can also be used to predict a controlled low-pressure fuel pump.

FIG. 1 shows the fuel system 10 for operating an internal combustion engine with high-pressure direct injection. A fuel system 10 with this architecture requires a certain fuel pressure level in a fuel rail 12. An electric low-pressure fuel pump 14 with a mechanical pressure controller 16 and a tank return line 18 supplies the inlet side of a high-pressure fuel pump 20 with a basic primary pressure. The pressure controller 16 prevents pressures that are too high from occurring when the low-pressure fuel pump 14 pumps fuel from a tank 17 to the high-pressure fuel pump 20. The pressure controller 16 in FIG. 1 need not necessarily be a mechanical pressure controller, but can also be an electric or electro-mechanical or magnetic pressure controller, to name but a few examples.

The fuel is supplied from the high-pressure fuel pump 20 into the rail 12 and introduced into a cylinder space (not shown) by injection valves 22. An additional non-return valve 23 can be provided in the line between the high-pressure fuel pump 20 and the rail 12 for example. The non-return valve 23 prevents the fuel from escaping from the rail 12 back towards the high-pressure fuel pump 20. In order to regulate the actuation of the actuating element of the high-pressure fuel pump 20 for supplying fuel into the rail 12, the fuel system 10 uses the signal from a fuel pressure sensor 24 for feedback.

The injection mass of the injectors or the injection valves 22 is primarily used to determine the quantity of fuel to be supplied. Deviations of the actual fuel pressure from the nominal fuel pressure are balanced out by increased or reduced supply from the high-pressure fuel pump 20. The high-pressure fuel pump 20 is affected by time delays in this respect, i.e. the pumped mass cannot be supplied by the pump 20 immediately, but only with a certain time delay, the time lag of the high-pressure fuel pump 20.

In normal operation (stationary), this does not generally present a problem. However, in operating states with a very high injection mass change, the fuel pressure can no longer track the nominal value quickly enough. An unfavorable operating state of this kind occurs primarily when there is a change-over of the valve stroke characteristic curve or a stroke change-over from a small to a large stroke and vice versa for example, because this results in a very high air mass change. However, this air mass change does not occur immediately after the actuation of the stroke change-over, but follows the actuation with a defined time delay, i.e. a time lag t2 of the stroke change-over.

Figure 2:
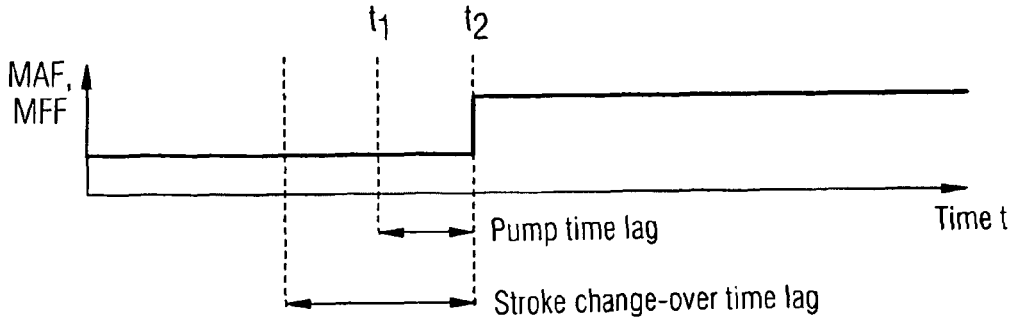
FIG. 2 shows a diagram in which the air mass MAF and/or the injected fuel MFF are shown as a function of the time.

The various embodiments now use the knowledge of this delay or the time lag t2 of the stroke change-over and the time lag t1 of the fuel system in order to regulate the request for a greater or smaller pump output MFP of the high-pressure fuel pump 20 at the correct time and thus to provide a suitable quantity of fuel at the correct time for a new stroke. In other words, when the signal for a stroke change-over, for example from a small stroke to a large stroke, occurs and is detected in a control device 26, as shown in FIG. 2, the associated air mass change dMAF is usually known. In this case, an appropriate pump output MFP for the high-pressure fuel pump can thus be calculated in the control device 26. Alternatively or in addition to the air mass change dMAF, the injection fuel quantity dMFF or the absolute injection fuel quantity MFF can also be used by the control device 26 for the calculation of the required pump output MFP, to name but a few examples.

This now means that when the time lag t2 of the stroke change-over has passed and the system is switching to the new stroke, i.e. to the larger stroke shown in FIG. 2 for example, the high-pressure fuel pump 20 must be actuated beforehand at the correct time by the ECU 26, being the control device, in order to provide a suitable quantity of fuel for the new stroke with a previously calculated pump output. When the high-pressure fuel pump 20 is actuated by the control device 26, the time lag of the high-pressure fuel pump 20 is also taken into consideration, as the pump 20 cannot provide the required quantity of fuel immediately. Due to the consideration of the time lag of the pump 20 and the time lag t2 of the stroke change-over or the time lag t1 of the fuel system, a sufficient quantity of fuel can be provided at the correct time if the system switches to the new (in this instance, larger) stroke and the switching process is completed, as shown in FIG. 2.

The various embodiments therefore may have the advantage that the high-pressure fuel pump 20 can be actuated beforehand in such a way that a suitable quantity of fuel for the new stroke can be provided at the correct time at the change-over to the new stroke. In contrast to this, the time-delayed reaction of the pump and, for example, the time-delayed stroke change-over process are not considered in the prior art, which means that even though a suitable quantity of fuel can be provided, this may be too early or too late for example. This has the consequence that too little fuel is supplied, for example, because it has been provided too early. This can now cause the fuel quantity to be subsequently adjusted and, for example, increased because the false assumption is made that the fuel quantity was previously too low. According to various embodiments, however, the appropriate quantity of fuel and the associated pump output MFP are determined for the new stroke in advance and the quantity of fuel is supplied to the fuel rail at the correct time, so that incorrect readjustment of the fuel quantity, as in the prior art, can be prevented. In doing so, the various embodiments take consideration of the time lag of the stroke change-over t2 and the pump 20, so that when the system changes to the next stroke the correct quantity of fuel for this can be reliably provided at the correct time.

The quantity of fuel pumped for each stroke is calculated using the following formula for example. As an alternative to the fuel injection mass MFF, the air mass MAF can also be used for example.

$$MFP = \begin{cases} t < t_1, & MFP = MFF_{act_lift} \\ t_1 < t < t_2, & MFP = MFF_{next_lift} \\ t > t_2, & MFP = MFF_{act_lift} \end{cases}$$

MFP: Mass fuel pump $MFF_{act_lift}$: Mass fuel flow (current stroke)

$MFF_{next_lift}$: Mass fuel flow (next stroke)

According to the above formula, the quantity of fuel pumped MFP is equal to the injection fuel mass $MFP=MFF_{act_lift}$ of the current stroke if the actual time t is smaller than the time lag t1 of the fuel system. If the actual time t is greater than the time lag t1 but smaller than the time lag t2 of the stroke change-over, the quantity of fuel pumped MFP is equal to the injection fuel mass $MFF_{next_lift}$ of the next, in this instance larger, stroke. If the actual time t is greater than the time lag t2 of the stroke change-over, the quantity of fuel pumped MFP is equal to the injection fuel mass $MFF_{act_lift}$ of the now current, and in this instance larger, stroke.

The various embodiments may be advantageous in that a greater regulation quality of the fuel pressure can be achieved in the ways mentioned above. Furthermore, emissions limits are easier to comply with, or may even be reduced.

Furthermore, the invention is not restricted to the embodiment of a fuel system as shown in FIG. 2. This is only used as an example in terms of its structure and elements in order explain the principle according to the present invention.

Furthermore, the invention is not restricted to the stroke change-over as a predetermined operating state, but can be applied to a variety of operating states for which the required quantity of fuel is essentially known beforehand in order to calculate an associated pump output.

What is claimed is:

1. A method for controlling a pump that is connected to a fuel rail of an internal combustion engine in order to provide a predetermined quantity of fuel to the fuel rail for a predetermined operating state, the method comprising the steps of:

determining a first time when the internal combustion engine will begin a next predetermined operating state, determining an output of the pump required to supply a predetermined quantity of fuel required by the next predetermined operating state and a second time required by the pump to supply the predetermined quantity of fuel, wherein if the second time is less than or equal to the first time then the pump supplies the predetermined quantity of fuel required by the next predetermined operating state at the first time, otherwise, the pump supplies the predetermined quantity of fuel used by a present operating state at the first time.

2. The method according to claim 1, wherein the pump is actuated before the first time of the next predetermined operating state.

3. The method according to claim 1, wherein the pump is actuated in such a way that, taking into consideration a time lag of the pump, the pump has pumped the predetermined quantity of fuel into the rail when the internal combustion engine begins the switch into the next predetermined operating state.

4. The method according to claim 1, wherein detection of a signal is used in determining whether the internal combustion engine is switching into the next predetermined operating state, wherein the next predetermined operating state is a stroke change-over to a next stroke and the internal combustion engine switching into the next stroke is detected using a signal for stroke change-over.

5. The method according to claim 1, wherein the output of the pump is determined from at least one criteria selected from the group consisting of an air mass change, an injection fuel mass change and an absolute injection fuel mass.

6. The method according to claim 1, wherein the pump is selected from the group consisting of a high-pressure pump and a low-pressure pump.

7. An apparatus for controlling a pump that is connected to a fuel rail of an internal combustion engine in order to provide a predetermined quantity of fuel to the fuel rail for a predetermined operating state, comprising:

a device for determining a first time when the internal combustion engine will begin a next predetermined operating state;

a device for determining during a present predetermined operating state an output of the pump required to supply a predetermined quantity of fuel required by the next predetermined operating state and a second time required by the pump to supply the predetermined quantity of fuel required by the next predetermined operating state, wherein if the second time is less than or equal to the first time then the pump will supply the predetermined quantity of fuel required by the next predetermined operating state, and if the second time is greater than the first time then the pump will supply the predetermined quantity of fuel required by the present predetermined operating state; and a control device for actuating the pump early enough in time to supply the predetermined quantity of fuel to the fuel rail at the first time.

8. The apparatus according to claim 7, wherein the device for determining the output of the pump takes into consideration at least one criteria selected from the group consisting of an air mass change, an injection fuel mass change and an absolute injection fuel mass in the predetermined operating state for the determination of the pump output for delivering the predetermined quantity of fuel.

9. The apparatus according to claim 7, wherein the control device actuates the pump as a function of a time lag of a switching process into the predetermined operating state and a time lag of the fuel system or a time lag of the pump.

10. The apparatus according to claim 9, wherein the control device is configured in such a way that it actuates the pump so that the pump has pumped the predetermined quantity of fuel into the rail at the end of the time lag of the switching process into the predetermined operating state, taking into consideration the time lag of the pump.

11. The apparatus according to claim 7, wherein the predetermined operating state is a stroke change-over to a next stroke and the detecting device detects the process according to when the internal combustion engine is switched into the predetermined operating state using a signal.

12. The apparatus according to claim 11, wherein the signal is a signal indicating the stroke change-over.

13. A system for controlling a pump that is connected to a fuel rail of an internal combustion engine in order to provide a predetermined quantity of fuel to the fuel rail for a predetermined operating state, comprising:

apparatus for determining whether a process occurs to switch the internal combustion engine into a next predetermined operating state and a first time when the next predetermined operating state will occur;

apparatus for determining an output of the pump if the process for switching the internal combustion engine into a predetermined operating state was detected and a second time required by the pump to supply the predetermined quantity of fuel, wherein if the second time is less than or equal to the first time then the pump will supply the predetermined quantity of fuel required by the next predetermined operating state, and if the second time is greater than the first time then the pump will supply the predetermined quantity of fuel required by the present predetermined operating state, wherein the pump output of the pump is selected so that the predetermined quantity of fuel for the operating state is provided by the first time; and apparatus for actuating the pump so that the pump provides the predetermined quantity of fuel when the predetermined operating state is achieved.

14. The system according to claim 13, wherein the pump can be actuated as a function of a time lag of the switch into the predetermined operating state and a time lag of the fuel system or a time lag of the pump.

15. The system according to claim 13, wherein the pump is actuated in such a way that, taking into consideration a time lag of the pump, the pump has pumped the predetermined quantity of fuel into the rail at the end of a time lag in the switch into the predetermined operating state.

16. The system according to claim 13, wherein the detection of a signal is used to determine whether a process for switching the internal combustion engine into a predetermined operating state is taking place, wherein the predetermined operating state is a stroke change-over to a next stroke and the process for switching the internal combustion engine into the next stroke is detected using a signal for stroke change-over.

17. The system according to claim 13, wherein the output of the pump is determined as a function of at least one criteria selected from the group consisting of an air mass change, an injection fuel mass change and an absolute injection fuel mass.

18. The system according to claim 13, wherein the pump is selected from the group consisting of a high-pressure pump and a low-pressure pump.

* * * * *